United States Patent [19]

Lööf

[11] 4,294,191

[45] Oct. 13, 1981

[54] SPRAY BOOTH

[76] Inventor: Ingemar Lööf, Fabriksgatan 6, S-560 10 Skillingaryd, Sweden

[21] Appl. No.: 100,750

[22] Filed: Dec. 6, 1979

[30] Foreign Application Priority Data

Dec. 6, 1978 [SE] Sweden ..... 7812532

[51] Int. Cl.[3] ..... B05C 15/00

[52] U.S. Cl. ..... 118/634; 98/115 SB; 118/DIG. 7

[58] Field of Search ..... 118/326, 634, DIG. 7; 98/115 SB; 15/301, 312 R

[56] References Cited

U.S. PATENT DOCUMENTS

| | | | |
|---|---|---|---|
| 2,579,575 | 12/1951 | Herdlein | 118/326 X |
| 3,010,129 | 11/1961 | Moore | 15/312 R X |
| 3,918,641 | 11/1975 | Lehmann et al. | 118/634 X |

*Primary Examiner*—John P. McIntosh

*Attorney, Agent, or Firm*—Burns, Doane, Swecker & Mathis

[57] ABSTRACT

A spray booth includes a housing having an internal surface with an opening through which are passed objects to be coated. First and second guides are positioned at opposed ends of the housing. A suction device is movable within the housing and includes an inlet opening facing the internal surface for sucking-in spray material which has not adhered to the object being sprayed. The suction device includes end portions which are guided by the first and second guides during its movement. The inlet surface extends across substantially the entire width of the internal surface between the guide-carrying ends of the housing. A drive mechanism is operably connected to the end portions of the suction device for moving the latter within the housing.

11 Claims, 6 Drawing Figures

SPRAY BOOTH

This invention relates to a spray booth of a type mainly intended for powder spraying of objects that hang from a conveyor and are conveyed through the spray booth. To facilitate cleaning of the spray booth but also to prevent coloring material from escaping from the spray booth the spray booth comprises an inlet device connected to a suction fan.

When applying coloring material to different kinds of objects by spraying it is inevitable that a certain portion of the sprayed material will not hit the object but is spread inside the spray booth. This means that the internal surfaces of the spray booth will be heavily contaminated by the colouring material. This contamination of the internal surfaces is further aggravated by the fact that often in electrostatic spraying for safety reasons it is necessary to electrically connect the internal surfaces of the spray booth with the object being sprayed. In doing so electrostatic forces will increase the adhereing of the coloring material to the internal surfaces so that, in a rather short time, considerable layers of coloring material can be built up. Particularly difficult is this contamination if the spray booth is used for powder spraying as the electrostatic forces adhering the coloring particles to the internal surfaces will decrease after a while which results in lumps of coloring material having a tendency of falling down onto the objects being sprayed. This means that, at least when changing from one kind of coloring material to another, it is absolute necessary to completely clean the internal surfaces of the spray booth before spraying can start again. In order to further eliminate the risk that colouring material falls down onto the object being sprayed it is prefered that the internal surfaces of the spray booth are cleaned more or less continiously.

The present invention has for its object to provide a spray booth of the kind indicated above, said spray booth being designed in such a way as to eliminate manual cleaning of the internal surfaces but to allow automatic cleaning partly during operation and partly during short stops when changing coloring material. The invention also has for its object to provide an inlet device for sucking off coloring material from the internal surfaces of the spray booth.

According to the invention these objects are achieved if the spray booth is characterized by an inlet device having an inlet opening in the vicinity of the internal surface of the spray booth said inlet device being connected to an operating device and being movable along at least a certain portion of the internal surface.

In a prefered embodiment the inlet device extends along the whole length of the spray booth, the latter being provided, at the ends thereof, with guides for cooperating with the end portions of the inlet device.

To guarantee adequate cleaning at all modes of operation, e.g., at varying negative pressure in the inlet device, the invention foresees that the internal surfaces of the spray booth or the inlet device is provided with means for positioning the inlet device at a predetermined distance from the internal surfaces.

In an embodiment of great practical importance the spray booth comprises a housing having the shape of a substantially rectangular tube said tube having at its corners arched wall portions. In this embodiment the guides are provided along the whole extent of the end edges of the housing substantially in alignment with the internal surface thereof, the guides being designed to position the inlet device at the predetermined distance from the internal surface and to receive chains connected with the inlet device, by means of which the inlet device by displacement of the chains is displaceable at the predetermined distance from the internal surface substantially along the whole extent thereof.

As an alternative to having the guides position the inlet device at the predetermined distance from the internal surface of the housing it is, according to the invention, possible to provide separate spacer means. This embodiment is particularly advantageous when the negative pressure in the inlet device is great or when the inlet device has a big area so that there is a great force due to the pressure difference urging the inlet device against the internal surface of the housing.

The invention is now to be described more in detail, reference is being made to the accompanying drawings on which:

Figure 1:
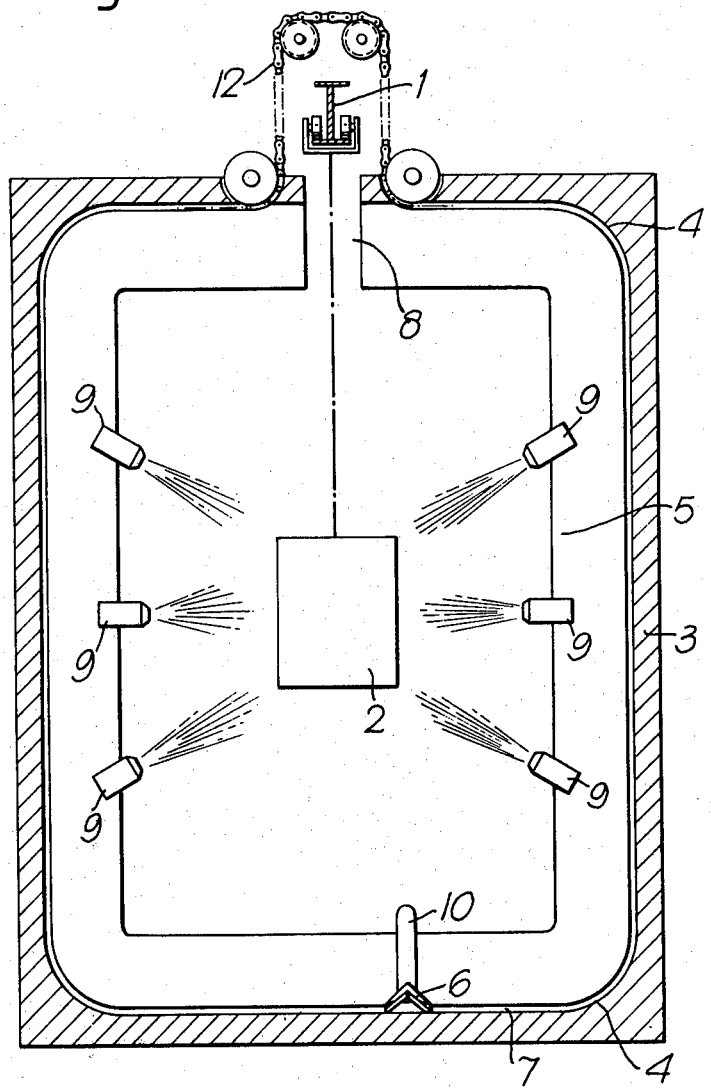
FIG. 1 is a schematical cross sectional view.

As is evident from FIG. 1 the spray booth comprises a housing 3 defining a tunnel like space having in an upper surface a longitudinally extending opening 8. Above this opening there is provided a conveyor 1 from which is hanging the object 2 which during its passage through the spray booth is to be covered with a coloring material sprayed from a number of spray guns 9 arranged in openings in the walls 3 of the housing. In the junction areas between the vertical and horizontal walls of the housing there is provided a circularly arched wall portion the purpose of which is to be described more in detail below. The internal surfaces of the housing are made from an even and smooth material, e.g., sheet metal, having a surface coating of such a material as Teflon (polytetrafluoro ethylene) or epoxy resin. The purpose of this surface coating is to decrease as far as possible the adhereing of the coloring material to the internal surfaces. If using an epoxy resin the coating can be improved in this respect by treating it with a wax for filling up the pores possibly present in the surface coating.

To encase, as far as possible, the health-impairing and dirty spraying process the ends of the spray booth are partially closed by means of baffle plates or end walls 5 which extend inwardly a certain distance from the horizontal and vertical walls and which are provided with openings for allowing the objects 2 to be conveyed therethrough. Further, close to the sidewalls 3 there are provided slots 7, the purpose of which is to described more in detail below.

Figure 2:
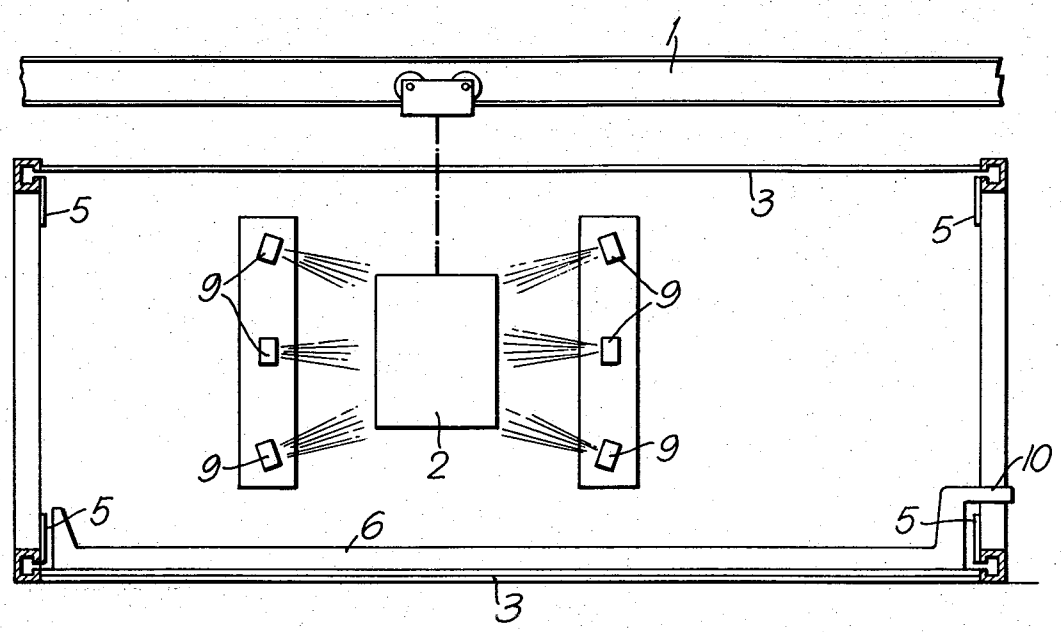
FIG. 2 is a longitudinal cross sectional view.
Figure 4:
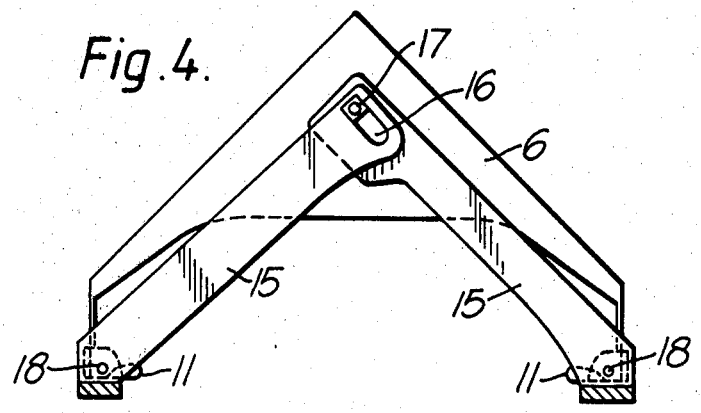

From FIG. 2 is evident that inside the spray booth there is provided an inlet or suction device 6 having at one end an outlet 10 communicating with a powerful suction fan. The inlet device 6 has (as is apparent from FIG. 4 and to some degree also from FIG. 1) an open side facing the internal surface of the spray booth. The ends of the inlet device are open substantially along the whole height of the end walls 5. It is also apparent that the shape of the inlet device 6 is pointed or roof-like towards the center line of the housing, i.e., upwardly as shown in FIG. 1 and 4. The purpose of this roof-like configuration is to have coloring material sliding off the inlet device if falling down on it. The inlet device 6 is suspended relative the housing in such a way that the distance to the internal surfaces is adjustable to a suitable magnitude. Finally, the cross sectional area of the inlet device 6 varies along its length in such a way that the flow velocity between the edge portions 11 of the inlet device facing the internal surface of the housing and this surface is substantially constant along the whole length of the inlet device 6 when the suction fan connected to the outlet 10 is operating. To help keeping the inlet device 6 free from adhereing coloring material, both on its external and internal surfaces, it is possible to provide a vibrator thereon.

According to the invention the inlet device 6 is arranged to move forwards and backwards along the internal bottom surface of the spray booth. By these movments there is prevented formation of thick layers of coloring material on the bottom of the spray booth which might otherwise occur inspite of the fact that the spray booth preferably is electrically connected with the object 2 being sprayed if the spraying is carried out in an electrostatic field. However, it is not necessary to continiously clean also the side walls and the ceiling of the spray booth during spraying as the surface coating of the internal surfaces has the properties of giving poor adhereing of the coloring material. When changing coloring material also the side walls and the ceiling of the spray booth have to be cleaned which is achieved by moving the inlet device 6 along these surfaces so that coloring material possibly adhereing thereto is drawn off into the inlet device. Prior to such a complete cleaning cycle it is necessary to withdraw the spray guns 9 from the openings in the side walls 3 of the spray booth.

To achieve the movability of the inlet device 6 as described above the inlet device 6 is at its ends connected to chains 12 running immediately outside the slots 7 mentioned above. At the conveyor 1 the chains run over a number of pulleys the arrangement of which need not be described. By guiding the chains 12 in this way the conveyor 1 will extend below the chains so that conveying of objects 2 is not prevented through the spray booth.

Figure 3:
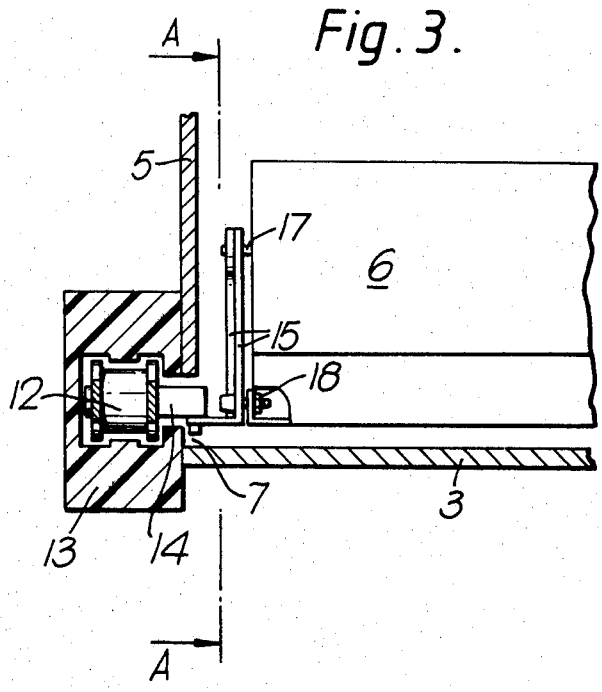
FIG. 3 is a detailed view of the connection between the inlet device and the spray booth, FIG. 4 an end view of a first embodiment of the inlet device substantially along line A—A in FIG. 3, FIG. 5 a side elevational view of a preferred embodiment of the inlet device and FIG. 6 a cross sectional view substantially along line B—B in FIG. 5.

From FIG. 3 is evident that there is provided guides 13 at the corner areas between the end walls 5 at one side and the side walls 3, the bottom wall and the ceiling on the other side. These guides are preferably made from a material having a low coefficient of friction, e.g., a plastics material. Internally of these guides 13 there are provided channels having a shape corresponding to the external shape of the chains 12. By this means the chains are properly received and guided in the guides 13. Further, the guides are located in such a way as to align the channel and the slot 7 so that pins 14 extending from the chain can extend through the slot 7. Arms 15 are adjustably fastened to these pins 14 and are in turn, e.g., by means of screws 18, adjustably fastened to the ends of the inlet device 6 at the lower corners thereof. The arms 15 extend towards the top line of the inlet device 6 and have in the vicinity thereof elongated openings 16 through which screws 17 extend, one fastened to each end of the inlet device 6. The second adjustable connection between the arms 15 and the inlet device 6 is achieved by means of the screws 18, the arms being, due to the provision of the elongated openings 16, pivotable to a certain degree relative to the inlet device 6. This ability of the arms 15 (and thus also of the pins 14 and the links of the chain 12 from which the pins extend) to pivot relative to each other is necessary when moving the inlet device 6 past the arched areas at the junction 4 of the side walls and the bottom wall and the side walls and the ceiling respectively.

In order of facilitate cleaning of the internal surfaces of the inlet device 6 the screws 18 are preferably designed and positioned in such a way as to be easily accessible for demounting purposes. When these screws 18 are removed it is possible to turn over the inlet device 6 about the pins 17 so that the open side thereof normally facing the internal surface of the spray booth is facing upwardly and the interior of the inlet device can be easily cleaned. Further, the described connection between the inlet device 6 and the chains 12 is such that the distance between the internal surfaces at the junction areas 4 and the longitudinal edge portions 11 of the inlet device 6 is substantially constant inspite of the curvature of the junction areas 4.

For driving the chains 12 there is preferably provided a drive unit not shown on the drawings but located on the upper side of the spray booth, said drive-unit being controlled by a number of position switches. To obtain the oscillating movement of the inlet device 6 along the bottom surface of the spray booth there is preferably provided at the junction areas 4 at least two position switches for reversing, possibly with time delay, the drive-unit and thereby the moving direction of the inlet device 6. To obtain a better guarantee that, in case of failure of any of these two position switches, the inlet device does not move up along one of the side walls 3 and hit the spray guns 9 inserted through an opening in this wall the position switches at the junction areas 4 are preferably doubled.

As mentioned above it is necessary to clean the whole internal surface of the spray booth when changing coloring material. To this end the inlet device 6 is moved along the whole internal surface one or more times. In doing so the function of the position switches at the lower junction areas 4 is taken over by a group position switches in the vicinity of the longitudinal opening 8. Further, the electric connections should be such that the inlet device 6 is prevented from passing the lower junction areas 4 unitl all spray guns 9 have been withdrawn from the spray booth.

Even if the guides described above adequately keep the predetermined distance between the inlet device and the internal surface of the spray booth this arrangement is not sufficient under certain conditions. Thus, if the negative pressure in the inlet device is high and it has a big area (e.g., 200×6000 mm) facing the internal surface of the spray booth it will be urged with a great force against the internal surface. This force might increase the wearing of the guides 13 to a level not acceptable and might also deform the inlet device 6 due to its considerable length so that the inlet opening will be narrower at an intermediate portion thereof.

To remedy the problems indicated above the invention also provides an alternative embodiment of the inlet device 6. This inlet device also comprises a hollow body member having roof-like upper surfaces 19 and side surfaces 20 substantially perpendicular to the internal surface 23 of the spray booth. Further, the internal cross sectional flow area of the body member varies along the length thereof as described above so that the flow velocity in the elongated inlet openings 21 between the inlet device and the internal surface of the spray booth is substantially constant along the whole length of the inlet device. In practice this inlet flow velocity can amount to approx. 80 $^{m}$/sec. when using a 15 kW suction fan connected to the outlet 10.

As the body member is substantially open towards the internal surface 23 of the spray booth (FIG. 6) and there exists a considerable negative pressure inside it there is created a force against the surface 23 amounting to approx. 2000–6000 kp. Therefore, the inlet device 6 must be designed in such a way as it is not deformed under this big load and further in such a way that the width of the inlet openings 21 is not affected. Finally this force must be taken up in such a way as not to over load the driving unit operating the inlet device 6. According to the invention this is achieved by providing sliding strips 22 on the surface 23 and having the inlet device 6 slide on these strips when moved along the internal surface 23. To decrease friction the sliding strips 22 are made from a material having a low coefficient of friction. Preferably these strips are arranged perpendicularly to the longitudinal direction of the inlet device 6 and thus parallell to the moving direction thereof. However, it is also possible to arrange the sliding strips 22 at a certain angle (preferably acute) to the moving direction. In doing so there is achieved the advantage that the sliding strips will not wear the same area on the inlet device but the wearing will be evenly distributed over the surface of the inlet device facing the internal surface 23. Further, there is achieved a certain effect of rubbing of dirt.

As an alternative to the sliding strips 22 there could be provided in the body member spacers having the same function as the sliding strips but being constituted by sliding blocks or roller members. Roller members rotably provided in the body member also offer the great advantage of a considerably lower friction when moving the inlet device 6.

As is mentioned above there is created by means of the suction fan a high flow velocity of approx. 80 $^{m}$/sec. in the elongated openings 21 at the lower edges of the inlet device 6. However, this high flow velocity is not a sufficient guarantee for keeping the surface 23 clean as the coloring material often is heavy, consists of very small particles and often is electrostatically adhered to the surface 23. Experiments have proved that such types of inlet devices where the coloring material is lifted more or less perpendicularly from the surface 23 have very poor efficiency. The experiments have also proved that an inlet device creating a flow pattern with uniform and high flow velocity directed substantially along (ie parallell to) the surface 23 has a high efficiency in practice. A possible explanation could be that the flow force exerted on the particles of the coloring material is directed substantially perpendecularly to the electrostatic forces so that the particles easily are brought in motion in this direction and are accelerated to velocities high enough to have them leave the surface 23, all this also being due to the width of the flow area having the high and uniform flow velocity. When accelerated in this way the particles are efficiently carried away by the flowing air even if the flow velocity later should decrease rather significantly.

To further improve the ability of the flowing air to carry away the coloring material the flow pattern should be designed in such a way that the area with high and uniform flow velocity is followed by an area with a certain degree of turbulence said turbulence facilitating the breaking up of and desintegrating of such lumps of coloring material that possibly can have been torn away from the surface 23.

The flow pattern described above is achieved in that the inlet device 6 on its lower side adjacent its side surfaces 20 comprises channel forming surfaces 24 facing the internal surface 23 of the spray booth. The channel forming surfaces 24 and the side surfaces 20 have evenly arched junctions 25 (where "evenly arched" should be related to the height of the inlet openings 21). The inner edge portions of the channel forming surfaces 24, i.e., the down stream edges, and vertical or obliquely upwardly and outwadly directed surfaces 27 also have evenly arched junctions 26. The upper ends of the surfaces 27 are in the shown embodiment fastened to mid-portions of the side surfaces 20. In practice the side surfaces 20, the channel forming surfaces 24 and the upwardly directed surfaces 27 could be integrally made from sheet metal necessary bendings at the junctions 25 and 26 having a suitable bending radius.

Figure 6:
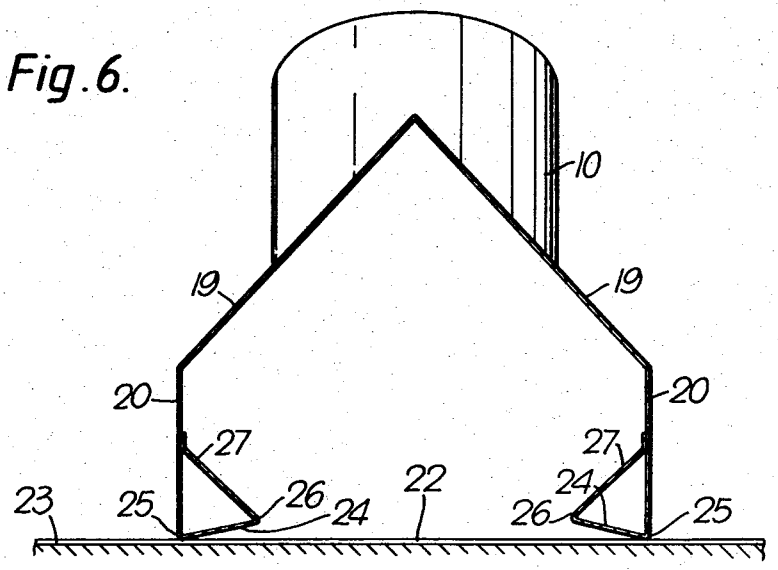
Figure 5:
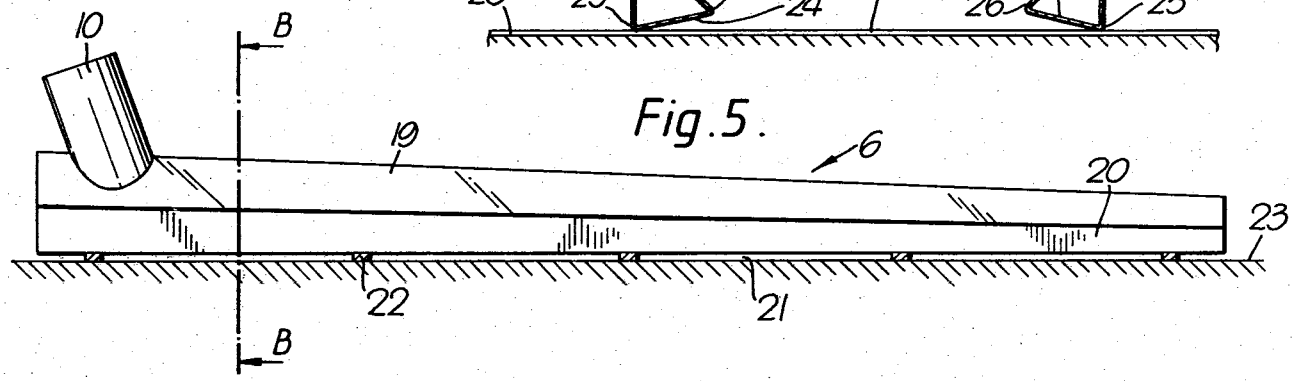

As is apparent from FIG. 6 the channel forming surfaces 24 are not parallell to the internal surface 23 of the spray booth but form such an acute angle thereto that the flow cross sectional area of the inlet openings 21 increases in the flow direction. In this way there is created a flow pattern incorporating flow components of very high velocity substantially parallel to the surface 23 in band shaped areas beginning at a distance outwardly of the junctions 25 and extending a certain distance inwardly thereof, i.e., below the channel forming surfaces 24. Due to the oblique orientation of the channel forming surfaces 24 there is created in the area between these surfaces and the internal surface 23 of the spray booth a turbulent flow pattern in which lumps of coloring material easily are broken up so that the particles therein become free. The turbulence in this area is also dependent on the radius of the arched junction 25, i.e., in such a way that a decreased radius has a tendency of increasing the turbulence while a bigger radius could decrease the turbulence. The angle between the channel forming surface 24 and the internal surface 23 is preferably in the order shown in FIG. 6. However, the angle must be determined under consideration of available fan effect, the width of the channel forming surfaces 24 and the radius of the junctions 25. Angles giving good efficiency in practice should be found in the internal 5°–25°. Further, in practice it has turned out that a suitable width of the channel forming surfaces is approx. 15–50 mm while the hight of the sliding strips 22 preferably is approximately 2 mm.

The invention can be modified within the scope of the following claims. Thus it is possible to give the inlet device a rhombic cross sectional shape and a downwardly directed slot-like opening, preferably of adjustable width. To increase the flow velocity inside the inlet device it is possible to provide an inlet valve at the end remote from the outlet 10.

I claim:

1. A spray booth comprising:

a housing having an internal surface and at least one opening for introducing an object to be spray-covered by a spray material, said housing having opposed first and second ends and first and second guide means disposed at such ends, an inlet device movable within said housing and having an inlet opening facing said internal surface of said housing for receiving spray material which has not adhered to said object, said inlet device including first and second end portions which are guided by said first and second guide means, and drive means operably connected to said first and second end portions for moving said inlet device along said internal surface.

2. A spray booth according to claim 1, wherein said inlet opening extends substantially from said first housing end to said second housing end.

3. A spray booth according to claim 1, wherein said inlet device is provided with means for positioning said inlet device at a predetermined distance from said internal surface of said housing.

4. A spray booth according to claim 1, wherein said housing is provided with means for positioning said inlet device at a predetermined distance from said internal surface of said housing.

5. A spray booth according to claim 1, wherein said first and second guide means each extends along substantially the entire extent of a respective said end of said housing, said guide means being arranged to position said inlet device at a predetermined distance from said internal surface, said drive means comprising chain means connected to said inlet device for moving said inlet device along substantially the entire extent of said first and second guide means.

6. A spray booth according to claim 5, wherein said inlet device is adjustably connected to said chain means for adjusting said predetermined distance.

7. A spray booth according to claim 1, wherein said inlet device is provided with spacer means for maintaining said inlet device for a predetermined distance from said internal surface.

8. A spray booth according to claim 1, wherein said internal surface is provided with spacer means for maintaining said inlet device at a predetermined distance from said internal surface.

9. A spray booth according to claim 1, wherein said inlet device includes channel forming surfaces arranged for directing a flow of suction air substantially along said internal surface and into said inlet device.

10. A spray booth according to claim 9, wherein said channel forming surfaces are disposed along longitudinal sides of said inlet device and form acute angles with said internal surface of said housing such that the distance between said channel forming surfaces and said internal surface increases in the flow direction.

11. A spray booth comprising:

a housing having an internal surface and at least one opening for introducing an object to be spray-covered by a spray material, said housing having opposed first and second ends and first and second guide means disposed at such ends, an inlet device movable within said housing and having an inlet opening facing said internal surface of said housing for receiving spray material which has not adhered to said object, said inlet device extending substantially the entire distance of said housing between said first and second ends of said housing, and drive means operably connected to said inlet device for moving said inlet device along said internal surface.

* * * * *